US009682752B2

(12) United States Patent
Ellis et al.

(10) Patent No.: US 9,682,752 B2
(45) Date of Patent: Jun. 20, 2017

(54) DEFLECTION ABSORBING TENSIONER FRAME

(71) Applicant: Dril-Quip, Inc., Houston, TX (US)

(72) Inventors: Fife B. Ellis, Houston, TX (US); Steven M. Hafernik, Houston, TX (US); Neil B. Prasad, Houston, TX (US)

(73) Assignee: Dril-Quip, Inc., Houston, TX (US)

( * ) Notice: Subject to any disclaimer, the term of this patent is extended or adjusted under 35 U.S.C. 154(b) by 0 days.

(21) Appl. No.: 14/804,585

(22) Filed: Jul. 21, 2015

(65) Prior Publication Data

US 2016/0024853 A1 Jan. 28, 2016

Related U.S. Application Data

(60) Provisional application No. 62/027,466, filed on Jul. 22, 2014.

(51) Int. Cl.

| | |
|---|---|
| ***E21B 17/01*** | (2006.01) |
| ***B63B 35/44*** | (2006.01) |
| ***E21B 19/00*** | (2006.01) |
| ***B63B 9/06*** | (2006.01) |

(52) U.S. Cl.

CPC ..... *B63B 35/4413* (2013.01); *B63B 9/065* (2013.01); *E21B 19/006* (2013.01)

(58) Field of Classification Search

CPC ..... E21B 19/006; E21B 19/004; E21B 19/09; B63B 35/4413; B63B 9/065

See application file for complete search history.

(56) References Cited

U.S. PATENT DOCUMENTS

| | | | | |
|---|---|---|---|---|
| 5,641,248 | A * | 6/1997 | Arlt, III | E21B 19/006 166/350 |
| 2002/0084077 | A1 | 7/2002 | Finn et al. | |
| 2009/0145611 | A1* | 6/2009 | Pallini, Jr. | E21B 19/004 166/355 |
| 2012/0247783 | A1* | 10/2012 | Berner, Jr. | E21B 19/002 166/355 |
| 2013/0189035 | A1* | 7/2013 | Alloway | B65H 51/14 405/166 |
| 2014/0050536 | A1* | 2/2014 | Berner, Jr. | E21B 19/002 405/224.4 |
| 2015/0136412 | A1* | 5/2015 | Hafernik | E21B 19/002 166/360 |
| 2015/0315856 | A1* | 11/2015 | Birkeland | E21B 19/09 166/355 |

FOREIGN PATENT DOCUMENTS

GB 2299649 A 9/1996

OTHER PUBLICATIONS

Search Report issued in the related UK patent application No. GB1512852.3, mailed Nov. 25, 2015 (3 pages).

* cited by examiner

*Primary Examiner* — John Kreck
*Assistant Examiner* — Carib Oquendo
(74) *Attorney, Agent, or Firm* — Baker Botts L.L.P.

(57) ABSTRACT

An example deflection absorbing tensioner frame for a platform of an offshore vessel may include at least one metal beam supporting a tensioner. A deflection absorber may be coupled to at least one metal beam. The deflection absorber may be configured to absorb axial, rotational, and lateral deflections in a platform deck coupled to the deflection absorber.

18 Claims, 6 Drawing Sheets

DEFLECTION ABSORBING TENSIONER FRAME

CROSS REFERENCE TO RELATED APPLICATION

This application claim the benefit of U.S. Provisional Application No. 62/027,466, entitled "Deflection Absorbing Tensioner Frame" and filed Jul. 22, 2014, which is incorporated herein by reference for all purposes.

BACKGROUND

The present disclosure relates generally to development of subterranean formations and, more particularly, to a deflection absorbing tensioner frame.

With the increasing demand for hydrocarbons, the effective and efficient development of subterranean formations containing hydrocarbons has become critical. A number of different operations are performed in order to develop a subterranean formation and extract desired hydrocarbons therefrom. Such operations may include, but are not limited to, drilling operations, fracturing operations, and others. Typically, the equipment for these operations is at least partially located on a platform or deck above the subterranean formation. Moreover, the operations also typically include pipes, casings, or risers that extend thousands of feet downward from the platform or deck.

In an off-shore operation, the platform deck may be located on a vessel that is floating on a body of water above the formation, and a riser may extend from the platform deck to the sea floor to provide a sealed bore through which tools can be introduced into the formation. Because the floating vessel may be subject to movement caused by the body of water, a tensioner may be located on the platform deck to provide constant upward force on the riser independent of the movement of the floating vessel. This protects the riser from buckling or stretching when the floating vessel moves.

Typically, a tensioner system may consist of a frame, a plurality of hydro-pneumatic cylinders, and high and low pressure accumulators connected to the hydro-pneumatic cylinders. Typical tensioners frames may be bolted or welded to the platform deck. In certain cases, however, the platform deck itself may be subject to deflections caused by the movement of the vessel or forces applied to the platform deck by other equipment. These deflections have the potential to impart excess stress into the tensioner frame that may reduce the fatigue life of the tensioner frame and also may cause static failure.

BRIEF DESCRIPTION OF THE DRAWINGS

Some specific exemplary embodiments of the disclosure may be understood by referring, in part, to the following description and the accompanying drawings.

While embodiments of this disclosure have been depicted and described and are defined by reference to exemplary embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

The present disclosure relates generally to development of subterranean formations and, more particularly, to a deflection absorbing tensioner frame.

Illustrative embodiments of the present disclosure are described in detail herein. In the interest of clarity, not all features of an actual implementation may be described in this specification. It will of course be appreciated that in the development of any such actual embodiment, numerous implementation specific decisions must be made to achieve the specific implementation goals, which will vary from one implementation to another. Moreover, it will be appreciated that such a development effort might be complex and time-consuming, but would nevertheless be a routine undertaking for those of ordinary skill in the art having the benefit of the present disclosure. To facilitate a better understanding of the present disclosure, the following examples of certain embodiments are given. In no way should the following examples be read to limit, or define, the scope of the disclosure.

The terms "couple" or "couples," as used herein are intended to mean either an indirect or direct connection. Thus, if a first device couples to a second device, that connection may be through a direct connection, or through an indirect connection via other devices and connections. Further, if a first device is "fluidically coupled" to a second device there may be a direct or an indirect flow path between the two devices.

As will be appreciated by one of ordinary skill in the art in view of this disclosure, there are different types of tensioner systems (e.g., cassette and tendome) with frames that are attached to a platform deck when in use. Although the following description will focus on cassette-type tensioner frames for ease of explanation, this disclosure is not limited to cassette-type frames and is equally applicable to other types of frames, including tendome mounting.

Figure 1:
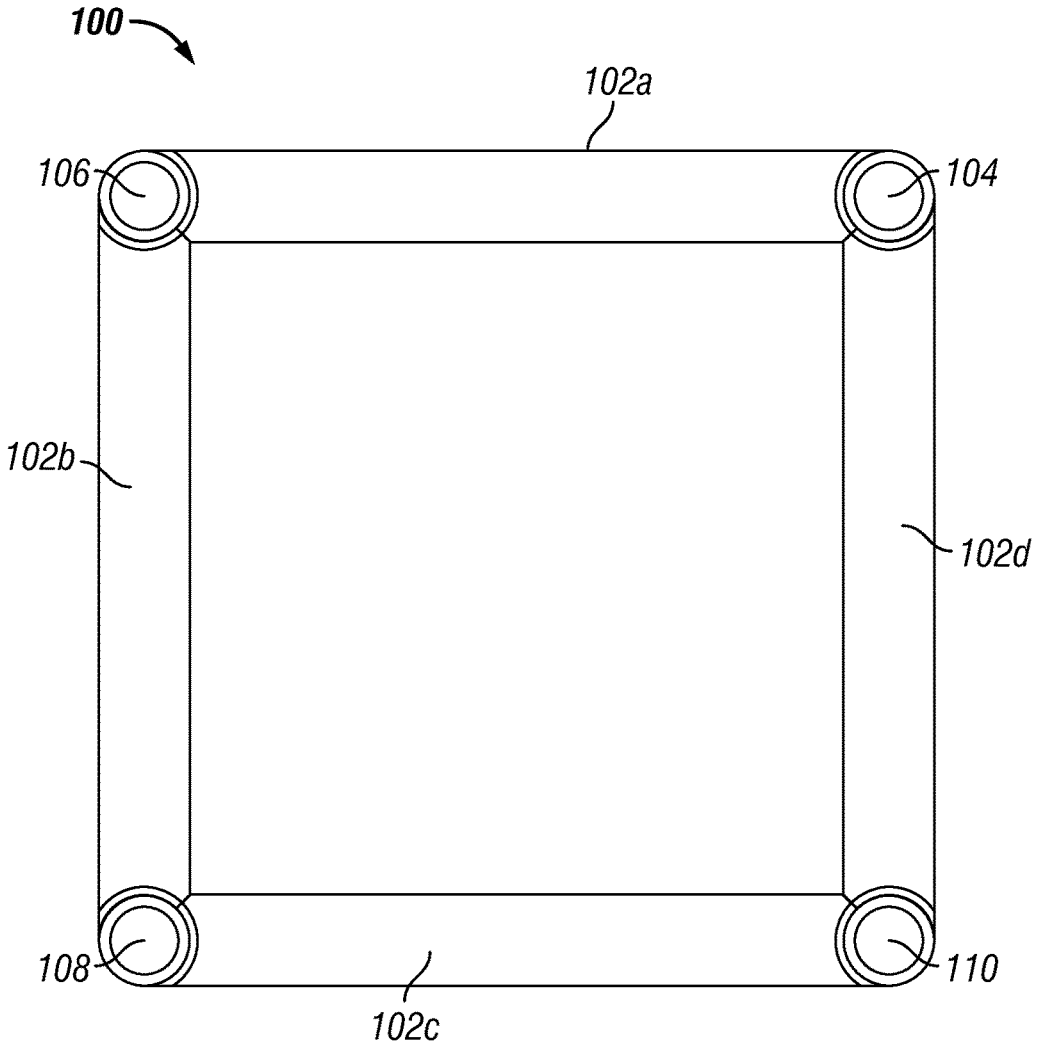
FIG. 1 shows an example deflection absorbing tensioner frame in accordance with an illustrative embodiment of the present disclosure.

Turning now to FIG. 1, a deflection absorbing tensioner frame in accordance with an illustrative embodiment of the present disclosure is generally denoted with reference numeral 100. The frame 100 may comprise a cassette-style tensioner frame that is constructed of four steel beams 102*a-d* arranged in a square or rectangle. Although the embodiment shown comprises a square or rectangular shape, it could comprise other shapes such as a circle or an octagon. Each corner of the frame 100 comprises a deflection absorber 104-110. In the embodiment shown, the deflection absorbers 104-110 comprise separately manufactured assemblies that are attached or otherwise welded onto the two beams to which each assembly is adjacent. For example, deflection absorber 106 may be bolted or welded to beams 102*a* and 102*b*. In other embodiments, the deflection absorbers 104-110 may be integrally formed with the beams, or at least part of the deflection absorber 104-110 may be integrally formed with the beam and the other part may be manufactured separately. In yet other embodiments, the beams 102*a-d* may be welded or bolted together directly, with the deflection absorbers 104-110 coupled to the frame 100 but outside of its structure.

As will be described in greater detail below, each of the deflection absorbers 104-110 may be a contact point between the frame 100 and a platform deck and function to isolate the tensioner frame 100 from the platform deck deflections. To the extent deflections in the platform deck occur, those deflections will be received and adjusted for before reaching the beams 102*a-d*, thereby reducing the stresses applied to the beams and extending the useful life of the tensioner system. Although four deflection absorbers 104-110 are shown at the corners of the frame 100, it should be appreciated that the number and location of the deflection absorbers may change depending on the intended operational conditions, and shape of the tensioner frame.

Figure 2:
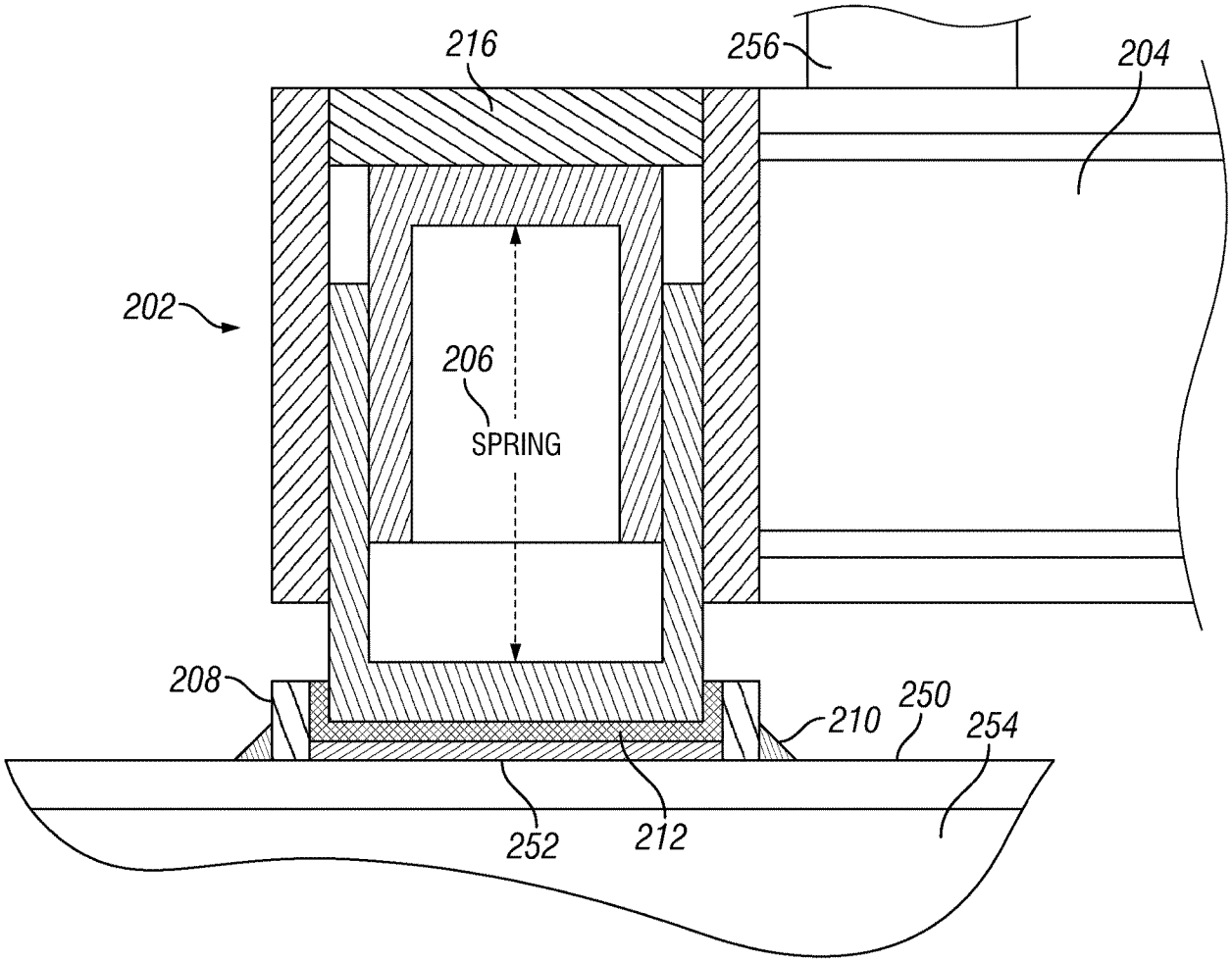
FIG. 2 shows a portion of an example deflection absorbing tensioner frame in accordance with an illustrative embodiment of the present disclosure.

FIG. 2 illustrates a portion of an example deflection absorbing tensioner frame in accordance with an illustrative embodiment of the present disclosure. In particular, FIG. 2 illustrates a cross-section of an example deflection absorber 202 coupled to a beam 204. The beam 204 may comprise a portion of a tensioner frame, similar to the tensioner frame described above, that is coupled to and otherwise supports a tensioner, which may include hydraulic, pneumatic, mechanical, or electrical elements mounted to the beam 204 through one or more supports 256. Although only one support 256 of the tensioner is shown, the various configurations of tensioners would be appreciated by one of ordinary skill in the art in view of this disclosure.

The deflection absorber 202 is coupled to a platform deck 250 of an offshore vessel 254 at a contact point 252. Example offshore vessels 254 include, but are not limited to, drilling rigs, boats, barges, and other vessels that would be appreciated by one of ordinary skill in the art in view of this disclosure. The deflection absorber 202 comprises at least one dynamic element, in this embodiment a spring 206. The spring 206 may comprise a pre-loaded spring that seeks to even the load between the deflection absorbers of the frame, a bearing-type spring that allows relative motion between the frame and the deck, or a combination of the two. The spring 206 may comprise elements of different types, including metallic, elastomeric, hydraulic, or pneumatic. The bearing elements can be made from different material including low-friction metals, composites, or elastomers.

In the embodiment shown, the spring 206 is built into the frame and comprises a hydro-pneumatic cylinder with a gas spring, a metal spring, or another type of spring that provides an axial force with a specified stroke, thereby absorbing and/or accounting for axial deflections in the platform deck 250. Specifically, the spring 206 may limit the load differential between each contact point of the tensioner frame while contracting and extending to accommodate vertical deck deflections.

In the embodiment shown, the deflection absorber 202 comprises a base 208 that is coupled to the deck 250 via a weld 210. In other embodiments, the base 208 may be bolted to or integral with the deck 250. As can be seen, the spring 206 may be at least partially within the base 208, such that vertical or axial movements in the deck 250 are first received at the base 208 and then at the spring 208, which may absorb the deflection and maintain the position of the beam 204.

In certain embodiments, the absorber 202 may comprise one or more elastomeric elements that absorb lateral, horizontal, or rotational deflections of the deck 250. In the embodiment shown, an elastomeric bearing 212 is positioned between the end of the spring 206 and the base 208. The elastomeric bearing 212 may allow for the end of the spring 206 to move within the base 208, such that lateral movements in the base 208 caused by deflections in the deck 250 are not transmitted to the spring 206 or the beam 204. The absorber 202 may further includes hard stops around the elastomeric bearing 212 and end of the spring 206 to ensure that the end of the spring 206 does not move too far within the base 208.

In the embodiment shown, the absorber 202 further comprises a removable element 216 that allows access to the dynamic elements of the absorber. Because dynamic elements such as springs and elastomers degrade over time, the removable element 216 may be useful to provide easy access to the dynamic elements so that they can be fixed or changed without removing the entire frame from the platform deck 250. Although the removable element is shown on the top surface of the absorber 202, other locations are possible.

Figure 3:
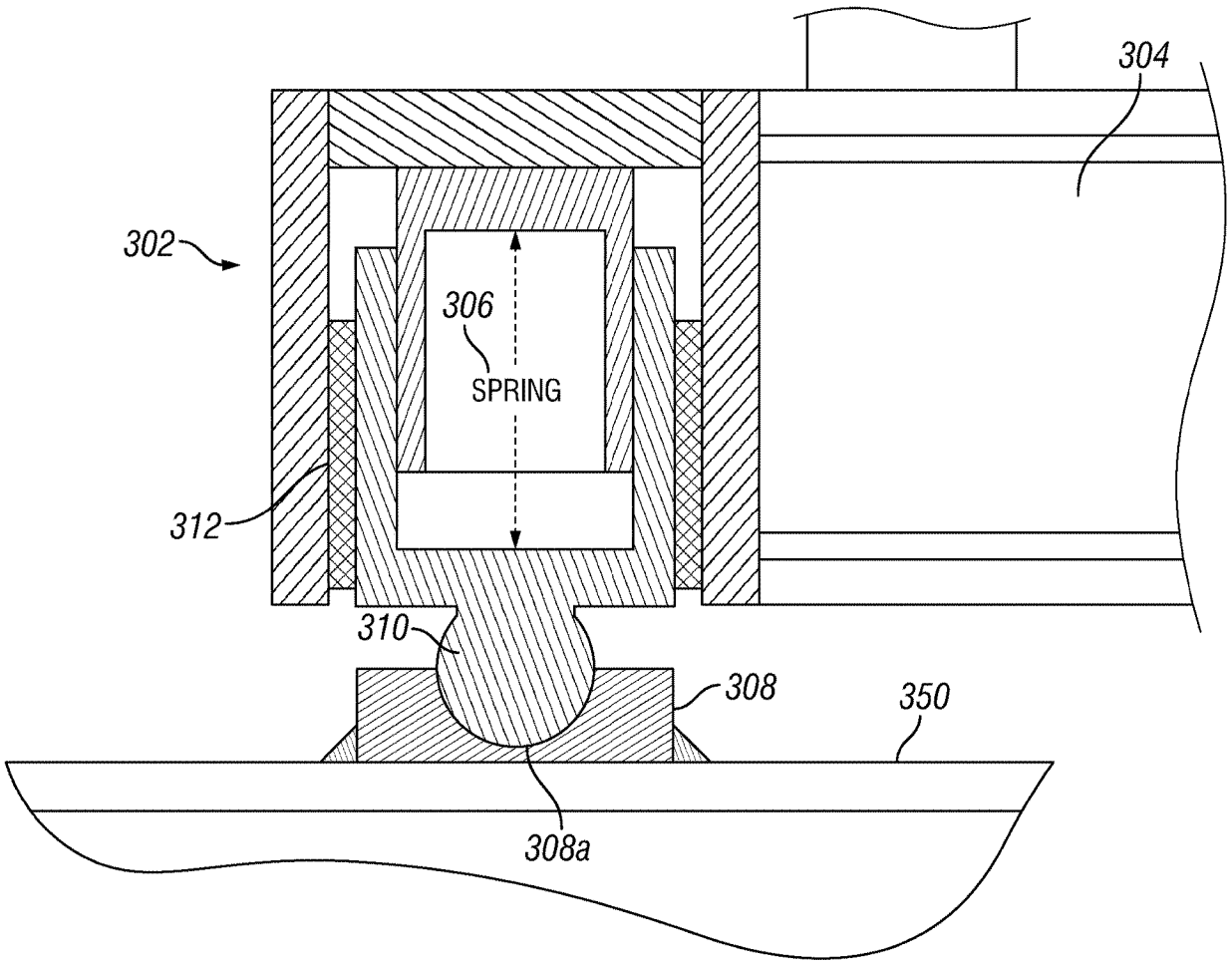
FIG. 3 shows a portion of another example deflection absorbing tensioner frame in accordance with an illustrative embodiment of the present disclosure.

FIG. 3 illustrates a portion of another example deflection absorbing tensioner frame in accordance with an illustrative embodiment of the present disclosure. In particular, FIG. 3 illustrates a cross-section of an example deflection absorber 302 coupled to a beam 304 and to a platform deck 350. The deflection absorber 302 comprises a spring 306 as a dynamic element, similar to the deflection absorber 202 in FIG. 2, but differs in the configuration of the base 308 and of the elastomer element 312 for lateral deflections. In particular, the base 308 comprises a spring bearing mating surface 308*a*, and the end of the spring 306 is coupled to a spring bearing 310 that interfaces with the mating surface 308*a*. When the deck 350 moves in a lateral direction, the base 308 may transfer some of the lateral movement to the spring 306 through the bearing 310 while the bearing 310 absorbs any rotational deflections. That lateral movement may be absorbed in the elastomer bearing 312 surrounding the spring 306, such that the lateral movement is not transferred to the beam 304, and the spring 306 can still absorb axial deflections in the deck 350.

Figure 4:
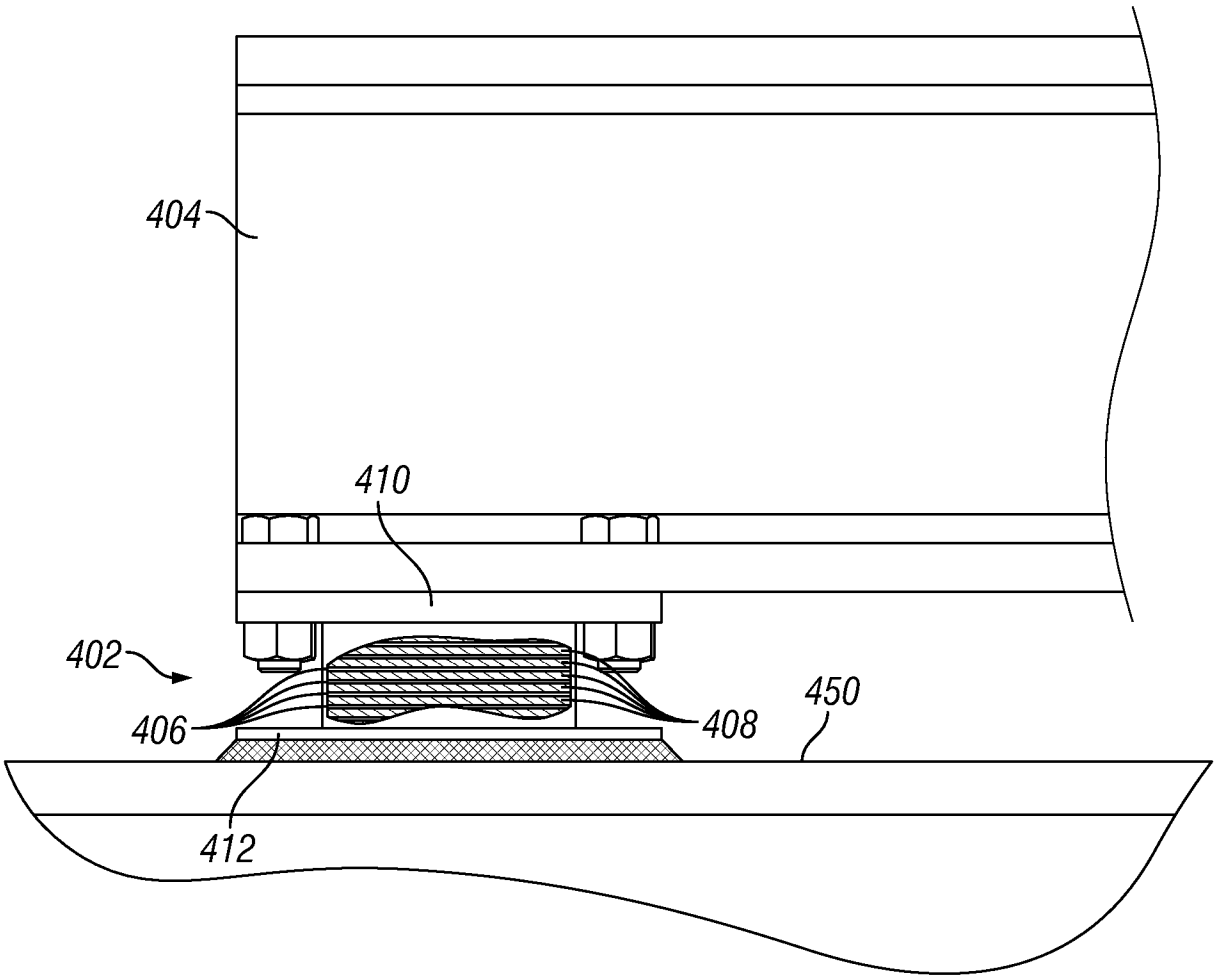
FIG. 4 shows a portion of another example deflection absorbing tensioner frame in accordance with an illustrative embodiment of the present disclosure.

FIG. 4 illustrates a portion of another example deflection absorbing tensioner frame in accordance with an illustrative embodiment of the present disclosure. The tensioner frame shown in FIG. 4 differs from those shown in FIGS. 2 and 3 in that the deflection absorber 402 is coupled to a bottom surface of a beam 404, rather than being integrated into the square or rectangular structure of the frame itself. The deflection absorber 402 also may be directly integrated into the frame as shown in FIGS. 2 and 3.

In the embodiment shown, the deflection absorber 402 comprises dynamic elements 406 in the form of layered or laminated rubber and steel shim elements. In particular, the dynamic elements 406 and steel elements 408 are layered in an alternating pattern. The dynamic elements 406 are not limited to rubber or other elastomeric elements, and may be comprised of other flexible elements. Examples include, but are not limited to, a fabric reinforced bearing. Additionally, the metal shims may be replaced by other non-metallic elements. In certain embodiments, the deflection absorber 402 may not be layered/laminated but a uniform element.

The absorber 402 is coupled to the beam 404 at a top portion 410, such as by a bolt or a weld, and to the deck 450 by a base 412. Axial or vertical deflections in the deck 450 are received by the base 412 and the dynamic elements 406, which compress and absorb the deflections, rather than transmitting the deflections to the beam 404. Lateral deflections in the deck 450 may cause the base 412 to move laterally with respect to the top 410, but the dynamic elements 406 may deform to accommodate the lateral deflection without imparting significant stress to the top 410 or the beam 404. Similarly, rotational deflections may be absorbed through twisting by the absorber 402.

Figure 5:
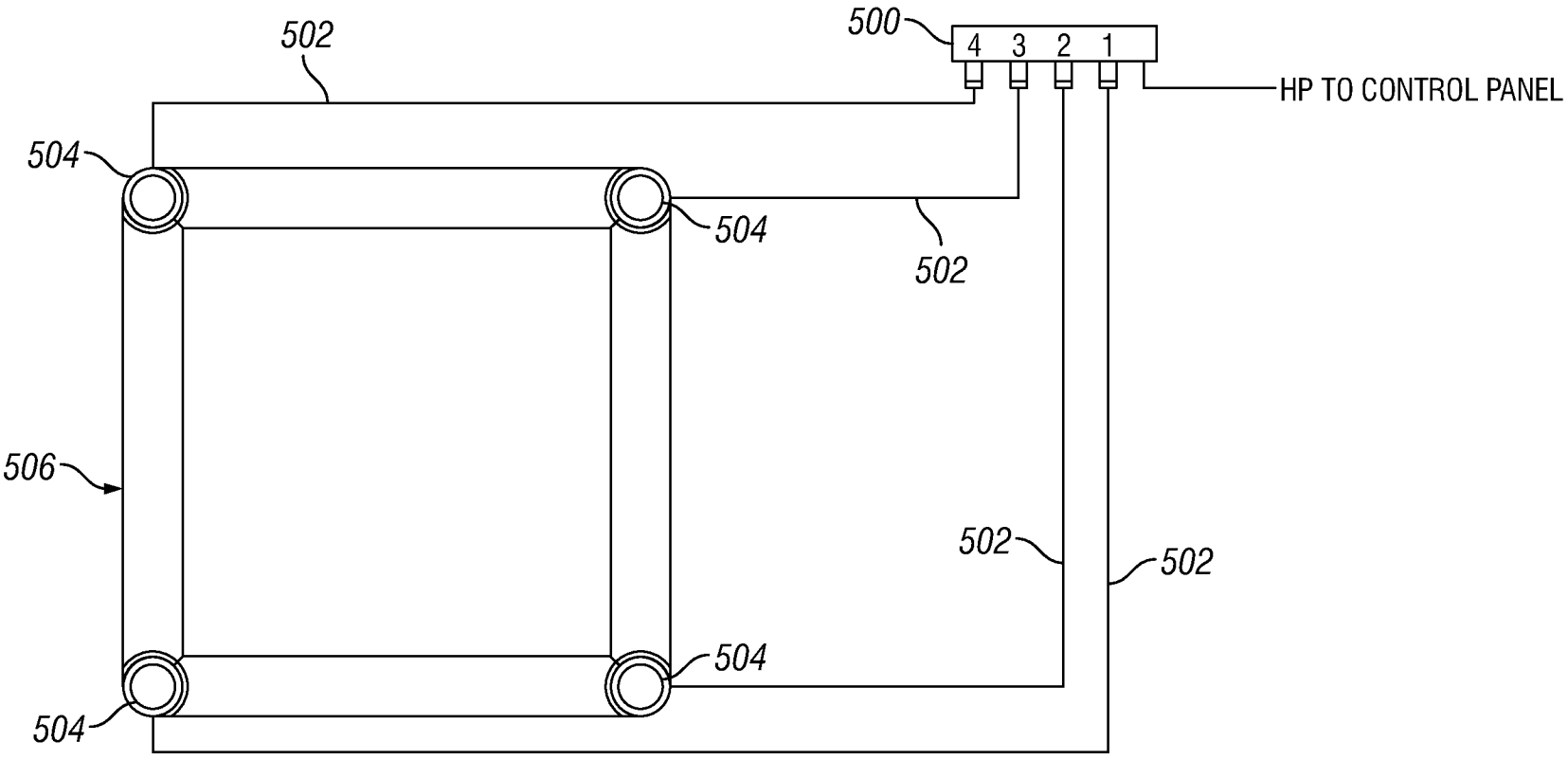
FIG. 5 shows an example deflection absorbing tensioner frame in accordance with an illustrative embodiment of the present disclosure.
Figure 6:
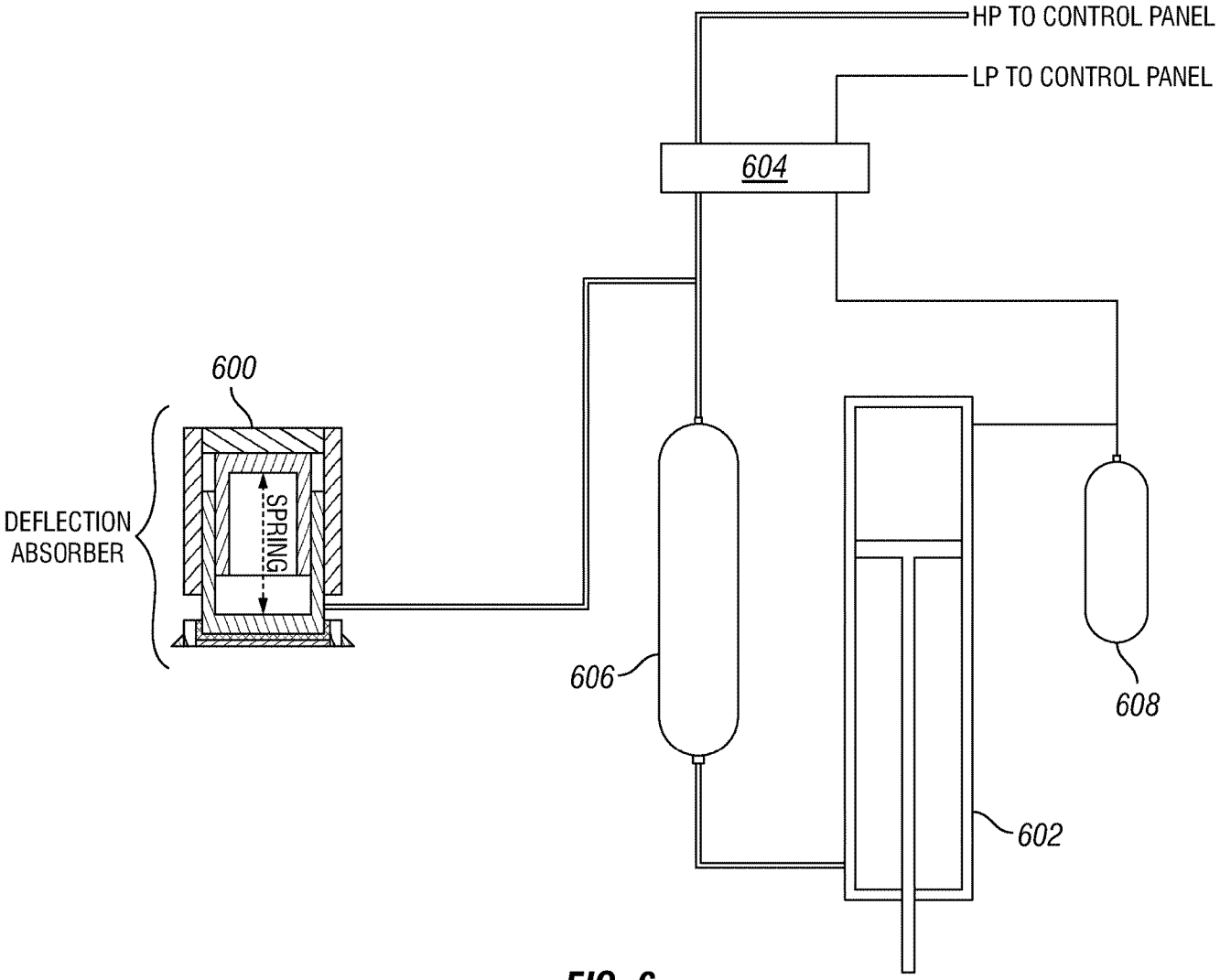
FIG. 6 shows a portion of another example deflection absorbing tensioner frame in accordance with an illustrative embodiment of the present disclosure.

In yet other embodiments, when the deflection absorbers comprise hydraulic or pneumatic spring elements, such as those shown in FIGS. 2 and 3, the spring elements may be connected to each other or to the tensioner frame by a fluid manifold that functions to keep the tensioner frame level during deck deflections. This is in contrast to having each deflection absorber act independently. In certain embodiments, as is shown in FIG. 5, the deflection absorbers may be connected by fluid lines 502 to each other by a fluid manifold 500. The fluid manifold 500 may function to balance the pressure within the hydraulic or pneumatic spring elements 504 when deflections in a platform deck coupled to the frame 506 causes one or more of the hydraulic or pneumatic spring elements to stroke. In certain embodiments, the fluid manifold 500 may be coupled to a control system or control panel that monitors and allows control of the fluid manifold. Example control systems or control panels mechanical systems as well as information handling systems with one or more processors that execute software to automatically issue control commands to the fluid manifold 500, or that execute software to provide a user interface through which a user can manually cause the processor to issue control commands to the fluid manifold 500. In other embodiments, as shown in FIG. 6, a deflection absorber 600 may be connected to a tensioner cylinder 602 by a fluid manifold 604 that is controlled, in part, by a control system or panel (not shown). The tensioner cylinder 602 may be fluidically coupled to a high pressure fluid 606 and low pressure fluid 608. When deflection occurs at one of the contact points, the other deflection absorbers may adjust accordingly to maintain even loading in the frame.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Even though the figures depict embodiments of the present disclosure in a particular orientation, it should be understood by those skilled in the art that embodiments of the present disclosure are well suited for use in a variety of orientations. Accordingly, it should be understood by those skilled in the art that the use of directional terms such as above, below, upper, lower, upward, downward and the like are used in relation to the illustrative embodiments as they are depicted in the figures, the upward direction being toward the top of the corresponding figure and the downward direction being toward the bottom of the corresponding figure.

Furthermore, no limitations are intended to the details of construction or design herein shown, other than as described in the claims below. It is therefore evident that the particular illustrative embodiments disclosed above may be altered or modified and all such variations are considered within the scope and spirit of the present disclosure. Also, the terms in the claims have their plain, ordinary meaning unless otherwise explicitly and clearly defined by the patentee. The indefinite articles "a" or "an," as used in the claims, are defined herein to mean one or more than one of the element that the particular article introduces; and subsequent use of the definite article "the" is not intended to negate that meaning.

What is claimed is:

1. A deflection absorbing tensioner frame for a platform of an offshore vessel, comprising:

at least one metal beam supporting a tensioner; and a deflection absorber coupled to the at least one metal beam, the deflection absorber configured to absorb axial, rotational, and lateral deflections in a platform deck coupled to the deflection absorber, wherein the deflection absorber comprises:

a spring configured to absorb the axial deflections in the platform deck;

an elastomeric bearing coupled to the spring, wherein the elastomeric bearing is configured to absorb the lateral deflections in the platform deck; and a base configured to couple to the platform deck and transmit forces and deflections from the platform deck to the spring, wherein the elastomeric bearing is positioned between an end of the spring and the base.

2. The deflection absorbing tensioner frame of claim 1, wherein the spring comprises at least one of a hydraulic and a pneumatic cylinder with at least one of a gas or metal spring.

3. The deflection absorbing tensioner frame of claim 2, wherein the at least one hydraulic and pneumatic cylinder is coupled to a fluid manifold to control deflection of the metal beam.

4. The deflection absorbing tensioner frame of claim 1, wherein an end of the spring comprises a spring bearing; and the base comprises a spring bearing mating surface coupled to the spring bearing, wherein the spring bearing is configured to absorb the rotational deflections in the platform deck while transferring the lateral deflections to the spring.

5. The deflection absorbing tensioner frame of claim 4, wherein the elastomeric bearing is disposed directly around an outer circumference of the spring to absorb the lateral deflections of the platform deck transferred to the spring through the base.

6. The deflection absorbing tensioner frame of claim 1, wherein the deflection absorber comprises a removable element to provide access to the spring.

7. The deflection absorbing tensioner frame of claim 1, wherein the tensioner comprises a plurality of hydro-pneumatic cylinders, a high pressure accumulator, and a low pressure accumulator.

8. The deflection absorbing tensioner frame of claim 1, wherein the deflection absorber further comprises stops disposed around the elastomeric bearing and an end of the spring to prevent the spring from moving laterally beyond the stops.

9. A system, comprising:

an offshore vessel comprising a platform deck;

a tensioner frame coupled to a riser tensioner and positioned on the platform deck; and at least one deflection absorber coupled to the tensioner frame and the platform deck, wherein the deflection absorber is configured to absorb axial, rotational, and lateral deflections in the platform deck, wherein the deflection absorber comprises:

a spring configured to absorb the axial deflections in the platform deck;

an elastomeric bearing coupled to the spring, wherein the elastomeric bearing is configured to absorb the lateral deflections in the platform deck; and a base coupled to the platform deck to transmit forces and deflections from the platform deck to the spring, wherein the elastomeric bearing is positioned between an end of the spring and the base.

10. The system of claim 9, wherein the tensioner frame comprises a plurality of metal beams; and the at least one deflection absorber is coupled to at least one of the metal beams.

11. The system of claim 10, wherein the tensioner frame comprises a rectangular shape; and the at least one deflection absorber comprises a separate deflection absorber positioned in at least one corner of the tensioner frame.

12. The system of claim 9, wherein the spring comprises at least one of a hydraulic and a pneumatic cylinder with at least one of a gas or metal spring.

13. The system of claim 12, further comprising a fluid manifold and control system coupled to the at least one hydraulic and pneumatic cylinder to control deflection of the tensioner frame with respect to the platform deck.

14. The system of claim 13, wherein the tensioner comprises a tensioner cylinder, a high pressure accumulator coupled to the tensioner cylinder, and a low pressure accumulator coupled to the tensioner cylinder, wherein the deflection absorber and the tensioner cylinder are fluidically coupled via the fluid manifold.

15. The system of claim 9, wherein an end of the spring comprises a spring bearing, wherein the base comprises a spring bearing mating surface coupled to the spring bearing, and wherein the spring bearing is configured to absorb the rotational deflections in the platform deck while transferring the lateral deflections to the spring.

16. The system of claim 15, wherein the elastomeric bearing is disposed directly around an outer circumference of the spring to absorb the lateral deflections of the platform deck transferred to the spring through the base.

17. The system of claim 9, wherein the deflection absorber comprises a removable element to provide access to the spring.

18. The system of claim 9, wherein the tensioner frame is a standalone component that supports only a single riser relative to the deck platform.

* * * * *